US006651921B1

(12) United States Patent
Travis

(10) Patent No.: US 6,651,921 B1
(45) Date of Patent: Nov. 25, 2003

(54) SPOOL WINDER

(76) Inventor: Weldon L. Travis, 645 Adams Loop, Tennessee Ridge, TN (US) 37178

( * ) Notice: Subject to any disclaimer, the term of this patent is extended or adjusted under 35 U.S.C. 154(b) by 0 days.

(21) Appl. No.: 10/261,387

(22) Filed: Sep. 30, 2002

(51) Int. Cl.[7] ..... B65H 54/00; B65H 75/12; B65H 75/30

(52) U.S. Cl. ..... 242/487; 242/597.4; 242/597.5; 242/597.8; 242/611; 242/902

(58) Field of Search ..... 242/487, 597.4, 242/597.5, 597.8, 486.9, 611, 395, 902

(56) References Cited

U.S. PATENT DOCUMENTS 2,531,816 A 11/1950 Homoky
3,042,329 A * 7/1962 Signorella ..... 242/487 X
3,652,027 A 3/1972 Wong
3,934,834 A * 1/1976 Gick et al. ..... 242/597.5 X
4,250,623 A * 2/1981 Pittinger et al. ..... 30/347
4,717,086 A 1/1988 Crow et al.
5,163,632 A 11/1992 Chilcoat et al.
5,370,326 A 12/1994 Webb
5,544,839 A 8/1996 Burch et al.
5,725,172 A 3/1998 Koehler et al.
6,254,029 B1 7/2001 Robertson et al.
6,491,247 B2 * 12/2002 Huettenegger ..... 242/611 X

* cited by examiner

*Primary Examiner*—John M. Jillions
(74) *Attorney, Agent, or Firm*—Thomas A. Lennox, Esq.

(57) ABSTRACT

A spool winder includes a holder for a filament bulk roll, a cantilever member to receive a weed trimmer filament spool, and a crank handle device rotating on the member while holding and interlocking into openings in the trimmer spool.

15 Claims, 7 Drawing Sheets

SPOOL WINDER

FIELD OF THE INVENTION

This invention is directed to a device that allows the rewinding of monofilament line onto emptied spools of a variety commercially available lawn trimming devices.

BACKGROUND OF THE INVENTION

The monofilament line is quickly worn away during heavy use of the standard commercially available lawn trimmers, all of the design of the original WEED EATER® devices. All of these devices use a replaceable spool to hold and feed out the monofilament line to a length which when spun a high rate of speed cuts grass and weeds around essentially any obstruction. When the obstruction is abrasive, such a stones or concrete, the monofilament line is quickly worn away. For lawns with such obstructions a lot of line is used. The manufacturers of these trimming devices enjoy a good business of selling replacement spools with a fresh supply of monofilament line. Commercial lawn care companies and frugal homeowners with their own trimmers have purchased the replacement line in bulk packages and attempted to rewind the spools that come with the trimming devices. Rewinding by hand without proper equipment is difficult due the elastic memory of the line, which causes it to snap back to its original shape of a much larger diameter than the small replacement spools. Some manufacturers have offered rewinding devices that accommodate only there own replaceable spools. An easy to use rewinding device that accommodates a wide variety of replaceable spool designs is needed.

U.S. Pat. No. 5,370,326 to Webb discloses a spool rewinder for monofilament lawn line trimmer devices using a plate to engage and mate with the adjacent side of the monofilament spool. It is not clear how this is accomplished except that the face of the plate is designed to be threadably snuggled up to grip the spool as the shaft tightened. U.S. Pat. No. 4,717,086 to Crow discloses a spool rewinder for monofilament lawn line trimmer devices using a resilient gripping washer to hold the spool to a crank handle with a lock washer and groove in the shaft to the shaft to the spool. U.S. Pat. No. 6,254,029 to Robertson et al discloses a spool rewinder for monofilament lawn line trimmer devices using lug keys to engage the lugs on two types of spools. U.S. Pat. No. 2,531,816 to Homoky discloses a spool rewinder for fishing reel devices using ratchet connections on the crank face to engage the spool to turn it one direction only. U.S. Pat. No. 5,163,632 to Chilcoat discloses a spool rewinder for monofilament lawn line trimmer devices using threadably tightened conical members to hold the spool to the shaft. U.S. Pat. No. 5,725,172 to Koehler et al discloses a spool winder for fishing line devices using a friction cone reel retainer to hold the spool to the shaft. U.S. Pat. No. 3,652,027 to Wong discloses a kite reel using engaging teeth. U.S. Pat. No. 5,544,839 to Burch discloses a spool rewinder for monofilament fishing line using O-rings to secure spool to crank shaft.

None of these devices satisfy the needs described above or attain the objects enumerated below.

SUMMARY OF INVENTION

It is an object of an embodiment of the present invention to provide a device that will support and hold a bulk roll of monofilament line and allow the line to be drawn off to a rewinding section to the device.

It is a further object of an embodiment of the present invention to provide a device that will support and hold a variety of replaceable line spools of differing sizes and shapes onto which a fresh supply of line can be easily wound from a bulk roll of the line.

It is an additional object of an embodiment of the present invention to provide a device that allows an empty replaceable spool to be easily inserted onto the device and held by a cranking device that rotates the spool winding the line onto the spool.

It is a further object of an embodiment of the present invention to provide a device that allows continuous tension to be applied to the line being drawn from the bulk spool with minimal risk of slippage of the replaceable spool.

It is an additional object of an embodiment of the present invention to provide a device that allows easy holding of the line that has been rewound on the replaceable spool to avoid the line springing off the spool and back to its original shape.

It is a further object of an embodiment of the present invention to provide an apparatus that can be held securely to a horizontal surface with one hand and wind the line from the supply onto the spool with the other hand.

It is a further object of an embodiment of the present invention to provide an apparatus that adjusts to various sized source rolls of line.

An embodiment of this invention is a spool winder apparatus that include a frame comprising a first end, a second end and a central section, a first vertical rod member that includes a first end rigidly attached to the frame proximate the first end and a second free end extending upwardly, at least one cup shaped member including a horizontal top, the member slideably engaged over the first rod member, a second vertical rod member that includes a first end rigidly attached to a center of the horizontal top of the cup shaped member and a second free end extending upwardly, the combination of the first rod member, the cup shaped member, and the second rod member adapted to extend into a central opening of a filament supply spool, and to support the supply spool and allow the supply spool to rotate as the filament is drawn off the supply spool. The apparatus further includes a cantilever member that includes a first end rigidly attached to the frame proximate the second end and a second free round cross-sectioned end section adapted to extend into a central opening of a weed trimmer filament spool, and to support the trimmer spool and allow the trimmer spool to rotate on the free end section. The apparatus further includes a stop means on the free end section to adjustably fix a chosen distance that the trimmer spool slides along the free end section and a crank handle device that includes a cylindrical member interfitting over and freely rotatable on the free end section, the member having a length and first and second ends, projections from the cylindrical member adapted to interlock into openings in the trimmer spool, and an "L" shaped crank member comprising a first end section rigidly attached to the cylindrical member and extending radially outwardly from the cylindrical member and a second free end section extending parallel to the length of the cylindrical member and away from the second end of the cylindrical member.

It is preferred that the first rod member have a circular cross-section and be vertically positioned. It is also preferred that the cantilever rod member be horizontally positioned. It is further preferred that the second free end section of the "L" shaped crank member has a rounded cross-section. It is further preferred that the projections from the cylindrical member adapted to interlock into openings in the trimmer spool extend outwardly from the first end of the cylindrical member. It is more preferred that the projections from the first end of the cylindrical member adapted to interlock into openings in the trimmer spool be arranged in a circular pattern. It is further preferred that the projections from the cylindrical member adapted to interlock into openings in the trimmer spool extend outwardly from the sides of the cylindrical member. It is further preferred that the apparatus further include removable stop means on the second free end section of the second cantilever member to retain the crank member in position on the free end section. It is further preferred that the apparatus further include an inverted "U" shaped member rigidly attached across the central section of the frame. It is further preferred that the apparatus further include a second cup shaped member that interfits between the first rod member and the cup shaped cup member.

A second embodiment of the invention is a spool winder apparatus that includes a frame and a first cantilever (circular) rod member having a first end rigidly attached to the frame and a second free end adapted to extend into a central opening of a filament supply spool, to support the supply spool, and to allow the supply spool to rotate as the filament is drawn off the supply spool. The apparatus further includes a second cantilever member having a first end rigidly attached to the frame and second free round cross-sectioned end section (disposed horizontally) that is adapted to extend into a central opening of a weed trimmer filament spool, to support the trimmer spool, and allow the trimmer spool to rotate on the free end section. The apparatus further includes a stop member on the free end section with adjustment means to fix the stop member at various positions on the free end section. The apparatus further includes crank handle device that includes a cylindrical member engaged over and freely rotatable on the free end section, the member having a length and first and second ends, projections from the first end adapted to interlock into openings in the trimmer spool, and an "L" shaped crank member comprising a first end section firmly attached to the cylindrical member and extending radially outwardly from the cylindrical member and a second (rounded cross-sectioned) free end section extending parallel to the length of the cylindrical member and away from the second end of the cylindrical member. The apparatus further includes removable stop means proximate the end of the free end section to abut the second end of the cylindrical member.

A third embodiment of the invention is a spool winder apparatus includes a frame and a first vertically positioned cantilever rod member comprising a circular cross-section, a first end rigidly attached to the frame and a second free end. The rod member is adapted to extend into a central opening of a filament supply spool, and to support the supply spool and allow the supply spool to rotate as the filament is drawn off the supply spool. The apparatus further includes a second cantilever member having a first end rigidly attached to the frame and second free round cross-sectioned end section horizontally positioned. The member is adapted to extend into a central opening of a weed trimmer filament spool, and to support the trimmer spool and allow the trimmer spool to rotate on the free end section. The apparatus further includes a stop member on the free end section with adjustment means to fix the stop member at various positions on the free end section. The apparatus further includes a crank handle device that includes a cylindrical member sliding over and freely rotatable on the free end section, the member having a length and first and second ends. The device further includes projections arranged in a circular pattern from the first end of the cylindrical member adapted to interlock into openings in the trimmer spool, and an "L" shaped crank member comprising a first end section firmly attached to the cylindrical member and extending radially outwardly from the cylindrical member and a second a rounded cross-sectioned free end section extending parallel to the length of the cylindrical member and away from the second end of the cylindrical member. The apparatus further includes a removable stop means on the second free end section of the second cantilever member to retain the crank member in position.

A fourth embodiment of the invention is a spool winder apparatus that includes a frame and a bulk spool holding means on an end of the frame to support a supply spool of line and allow the supply spool to rotate as the filament is drawn off the supply spool. The apparatus further includes a cantilever member having a first end rigidly attached to the frame and a free round cross-sectioned end section horizontally positioned. The free end section is adapted to extend into a central opening of a weed trimmer filament spool, and to support the trimmer spool and allow the trimmer spool to rotate on the free end section. The apparatus further includes stop means on the free end section adapted to adjustably fix the trimmer spool at chosen positions along the length of the free end section. The apparatus further includes a crank handle device that includes a cylindrical member sliding over and freely rotatable on the free end section of the cantilever section, the member having a length and first and second ends. The cylindrical member further includes projections from the first end adapted to interlock into openings in the trimmer spool, an "L" shaped crank member that includes a first end section rigidly attached to the cylindrical member and extending radially outwardly from the cylindrical member and a second free end section extending parallel to the length of the cylindrical member and away from the second end of the cylindrical member. The apparatus further includes lock means on the second free end section of the second cantilever member to detachably retain the crank member engaged with the trimmer spool.

It is preferred that the bulk spool holding means include a vertically positioned cantilever rod member with a circular cross-section. It is further preferred that the projections from the first end of the cylindrical member adapted to interlock into openings in the trimmer spool are arranged in a circular pattern.

DESCRIPTION OF PREFERRED EMBODIMENTS

Figure 1:
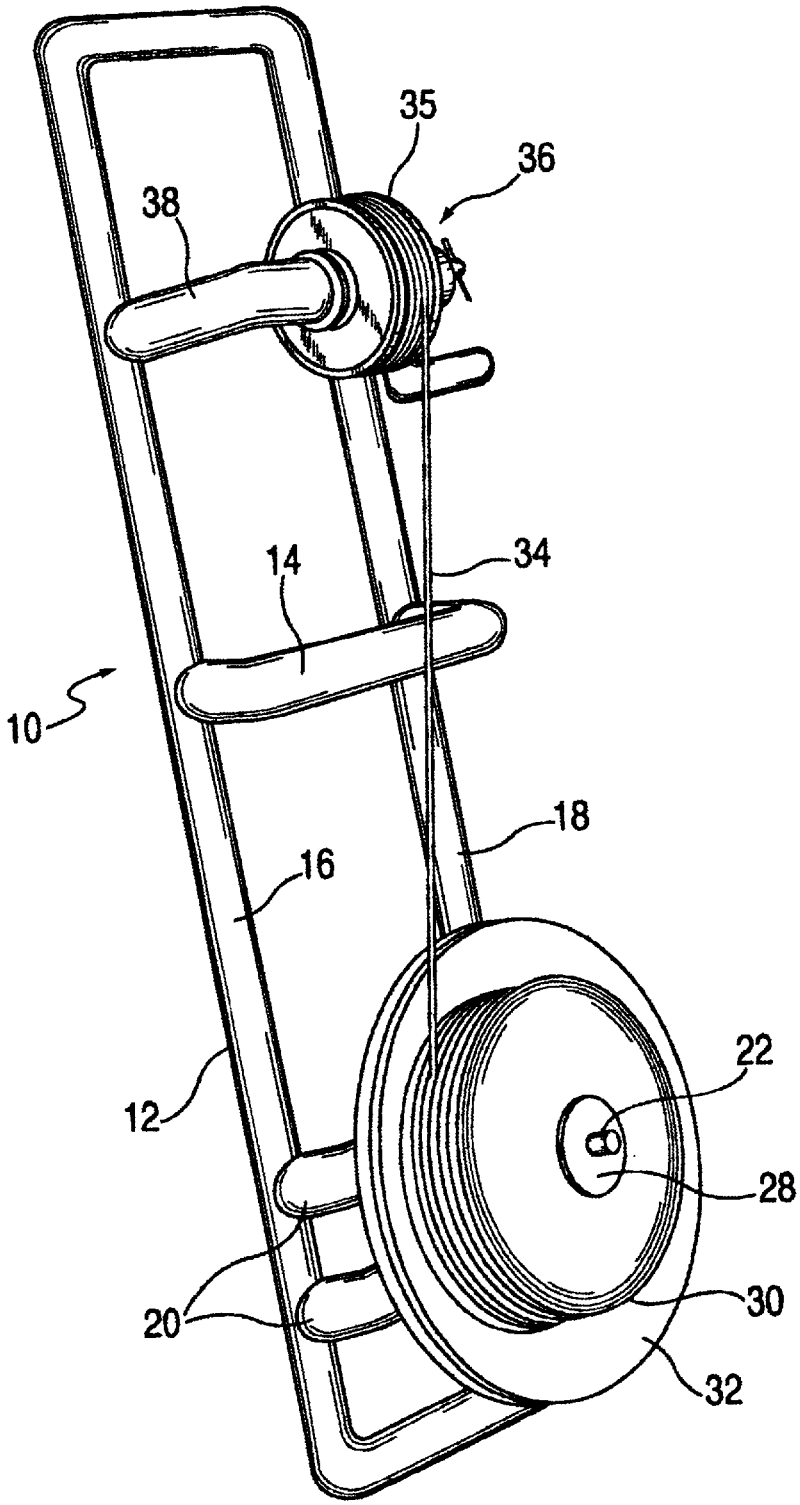
FIG. 1 is a front left side perspective view of an apparatus of the present invention.
Figure 1A:
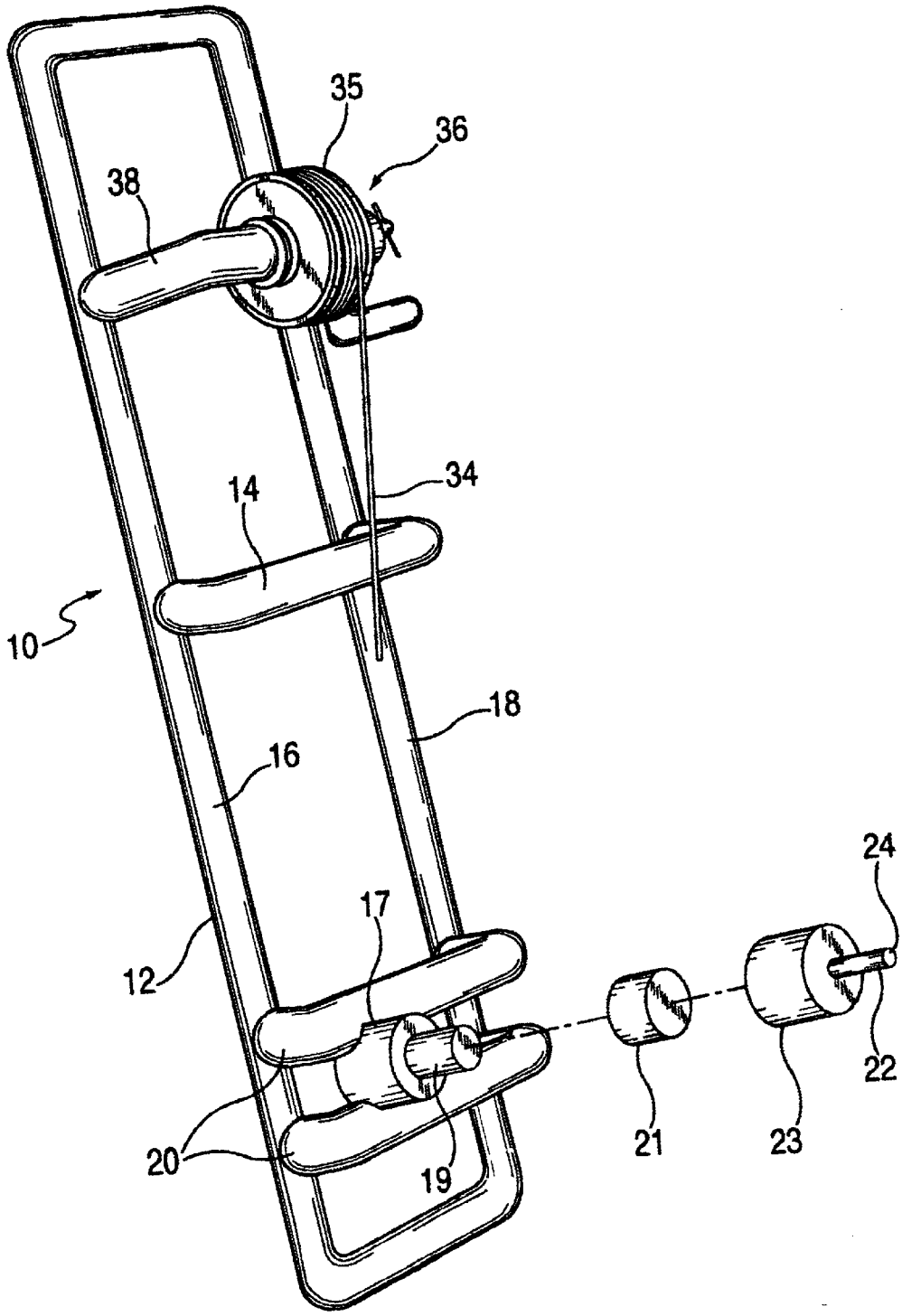
FIG. 1A is a front left side perspective view of said apparatus with the supply spool removed and spool size adjustment parts exploded outwardly.
Figure 2:
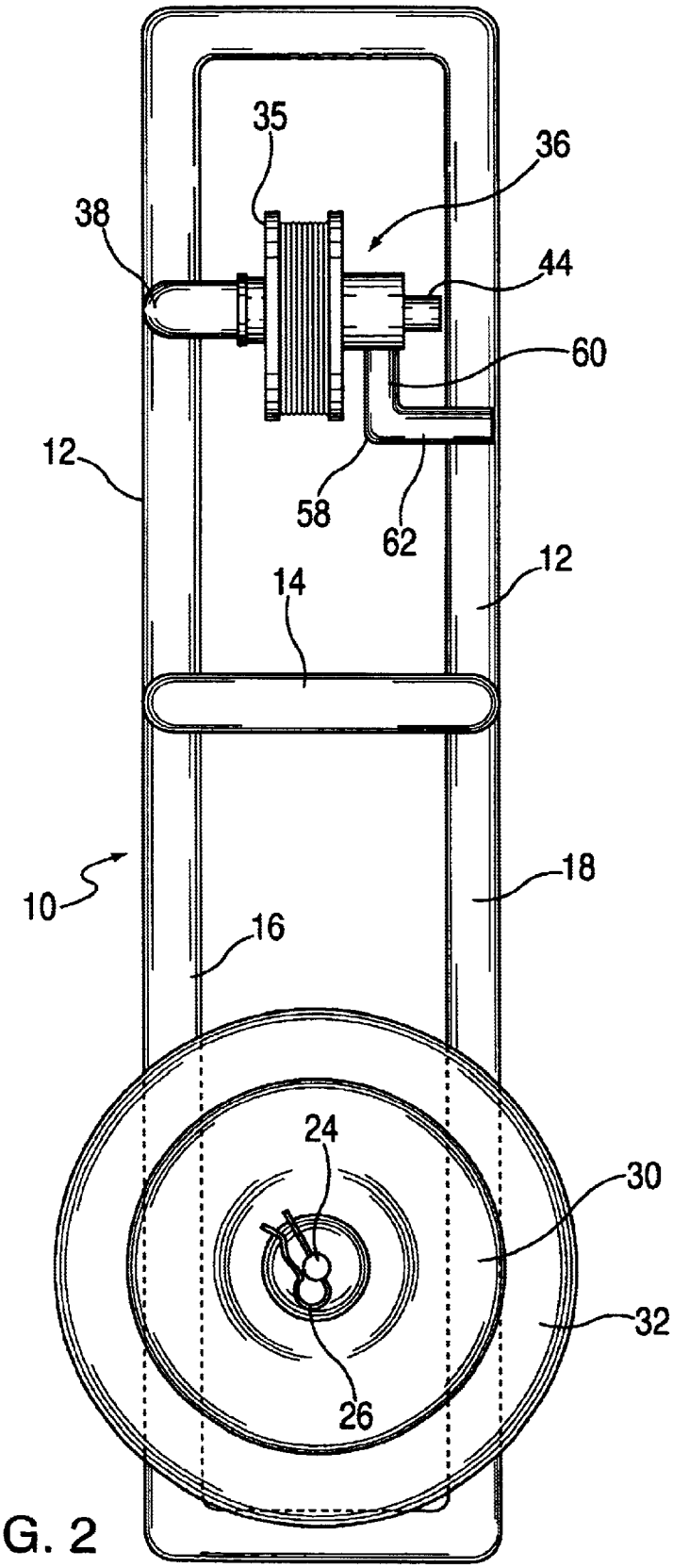
FIG. 2 is a top elevational view of said apparatus.
Figure 3:
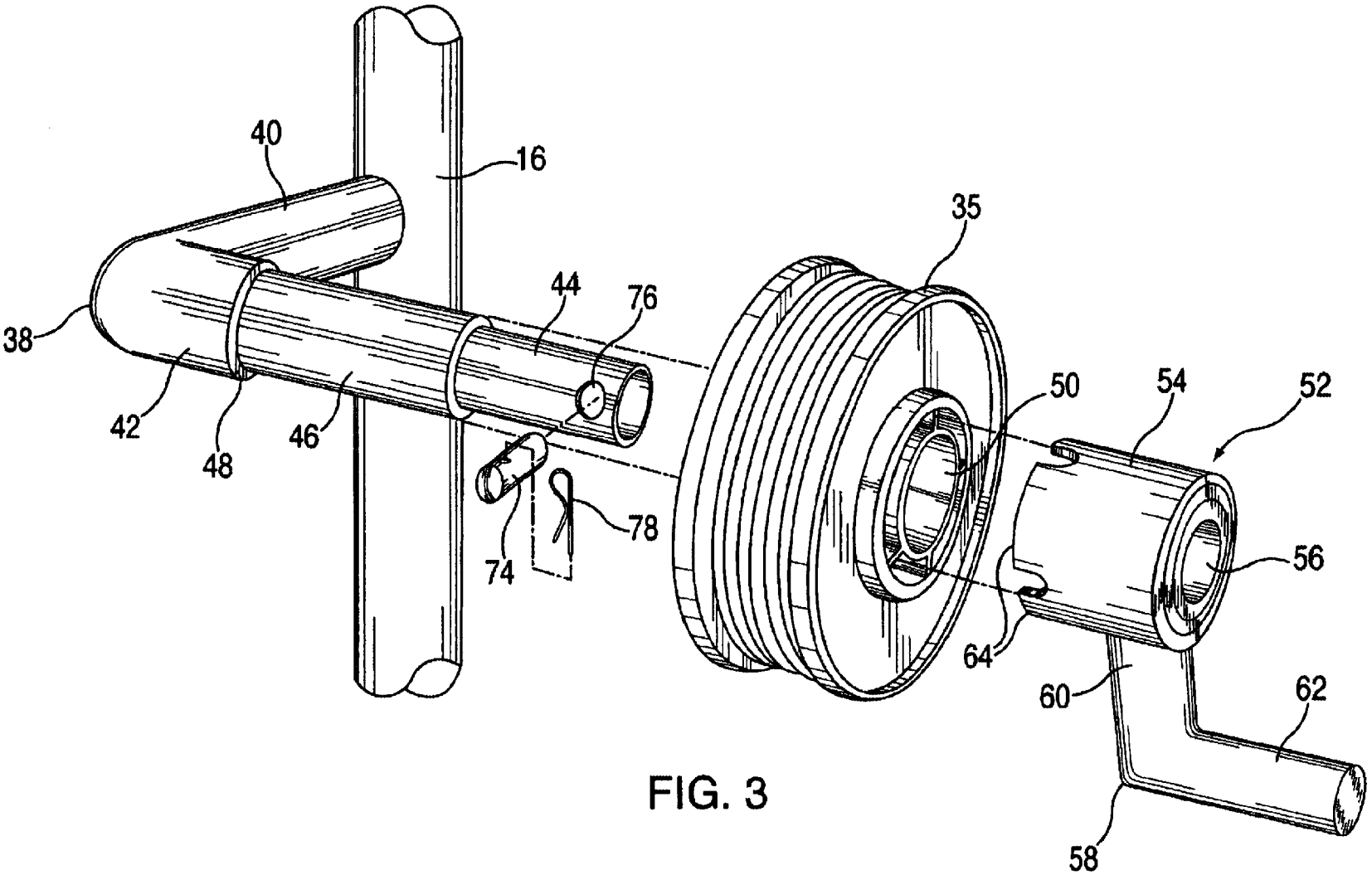
FIG. 3 is a cutaway partial exploded right side perspective view of the cranking and spool holding section of said apparatus.
Figure 4:
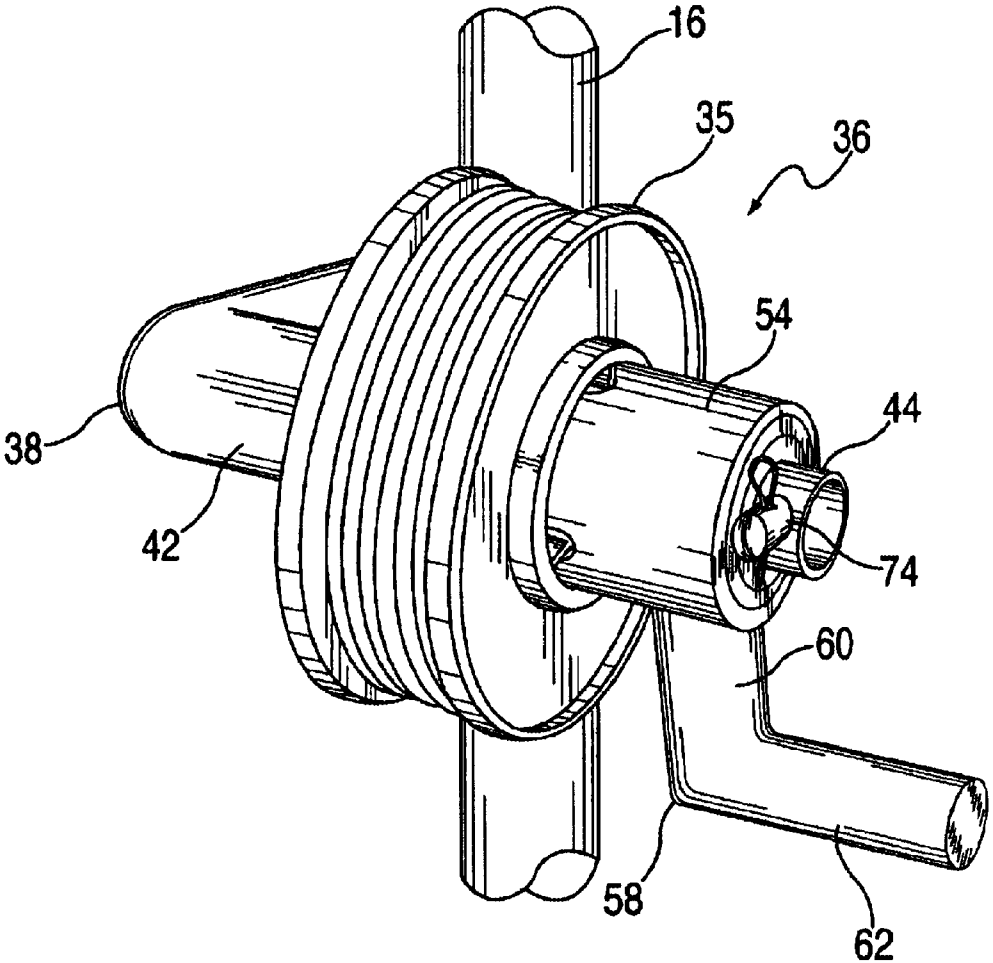
FIG. 4 is a front right side perspective view of the same section of the apparatus shown in FIG. 5 with the in working alignment.
Figure 5A:
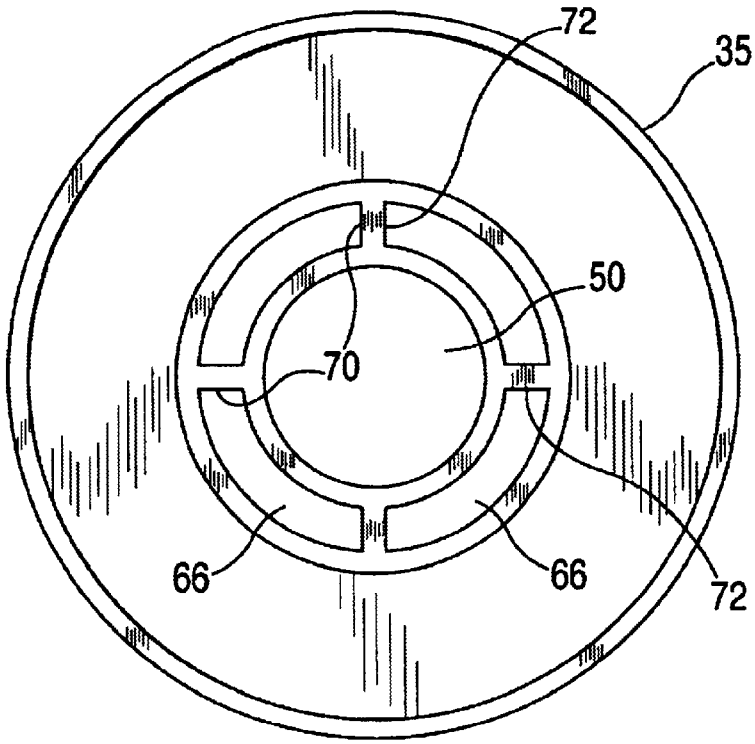
FIG. 5A is a right side plan view of a replaceable spool shown in use with said apparatus in prior figures.
Figure 5B:
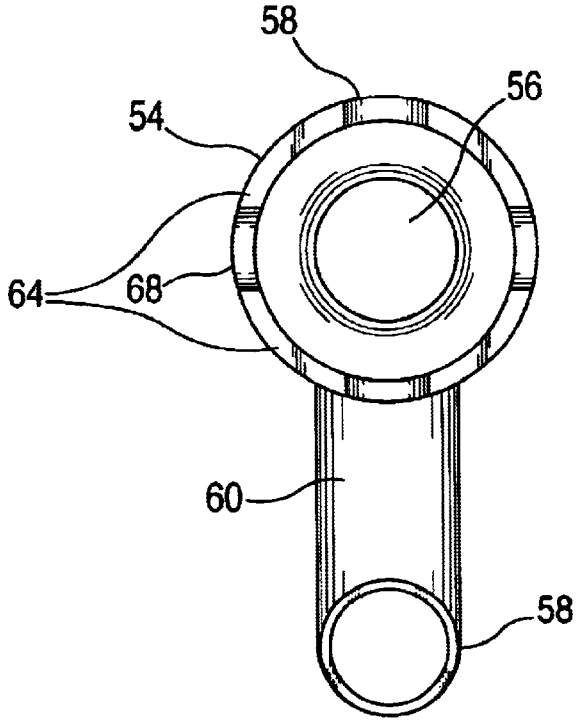
FIG. 5B is a left side bottom plan view of the crank and cylindrical member of said apparatus shown in prior figures.
Figure 6A:
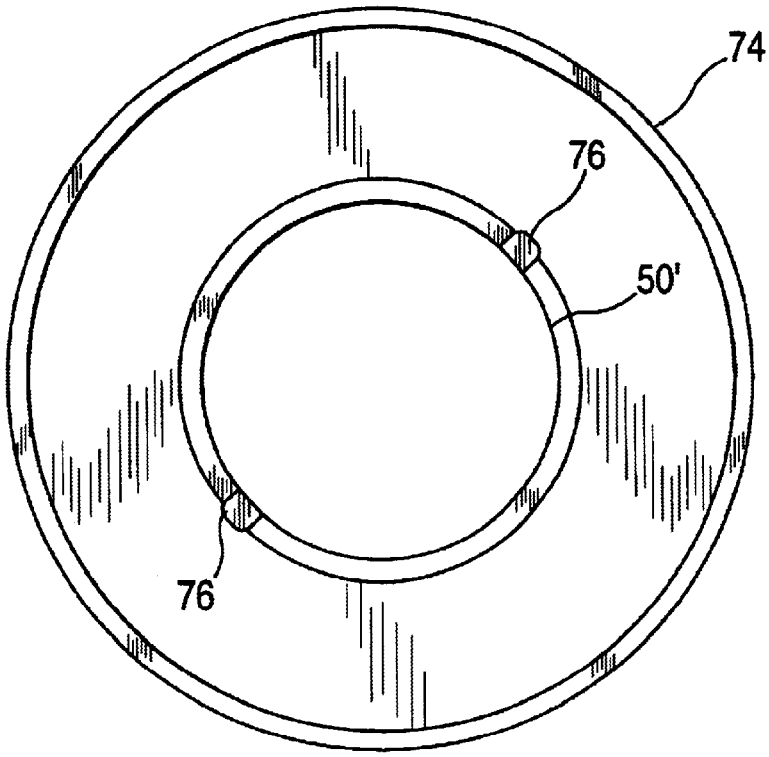
FIG. 6A is a right side plan view of a second replaceable spool shown in use with said apparatus in prior figures.
Figure 6B:
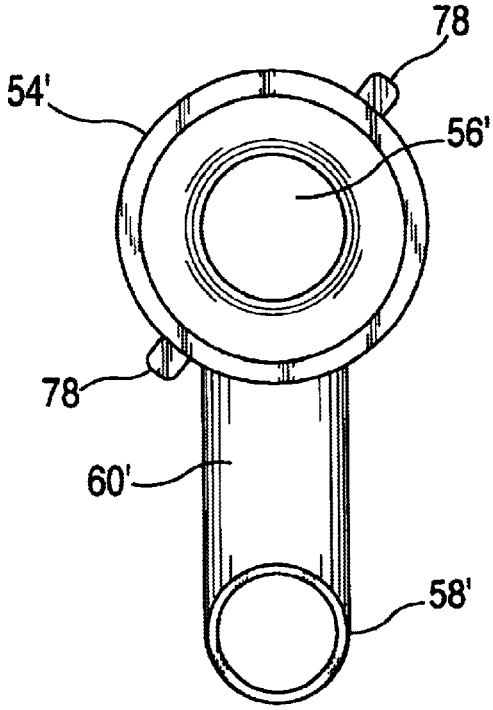
FIG. 6B is a left side bottom plan view of the crank and second embodiment cylindrical member of said apparatus shown in prior figures.

Spool winder apparatus 10, illustrated in FIGS. 1, 1A and 2, may be constructed entirely of polymeric plastic, such a rigid polyvinyl chloride, polystyrene, ABS, or preferably an engineering plastic, although certain parts such as cotter pins are more easily provided in metal. Apparatus 10 includes elongate rectangular base frame 12 with longitudinal side members 16 and 18 with upwardly extending inverted "U" shaped cross member 14 rigidly attached at its ends between the side members acting as a stiffener, a lifting handle and most importantly as a hand hold to securely hold the apparatus in place on a horizontal surface during the spool winding process. Frame 10 is also stiffened by cross members 20 extending between the side members proximate an end of the frame. Vertically disposed cylindrical base member 17 is rigidly attached centrally between cross members 20 with vertical rod member 19 attached to and extending upwardly from a top surface of base member 17. Inverted cup shaped spacer and alternate spool holder 21 slideably fits over member 19 and inverted cup member 23 slideably fits over spacer 21. Vertically disposed axle cantilever member 22 is rigidly attached at a lower end to a central position on a top surface of member 23 with member 22 extending upwardly and terminating at free end 24 through which a horizontal hole is provided to receive cotter pin 26 which holds disc washer 28 over a bulk roll 30 of monofilament replacement line supplied on package disc 32. Roll 30 and disc 32 are free to rotate on vertical member 22 as line 34 is drawn off to replaceable trimmer line spool 35, supplied on the trimmer by the manufacturer, that is held by spool holder and winding device 36 proximate the opposite end of frame 12 as also shown in FIG. 3 with parts exploded outwardly and ready to use in FIG. 4. Device 36 includes "L" shaped cantilever support member 38 with end section 40 extending vertically upwardly from its rigid end attachment to side member 16. Integral member 38 continues with section 42 extending horizontally toward side member 18 over frame 12 and terminating in reduced diameter circular cross-sectioned tubular cantilever section 44 held horizontally at a height over frame 12. Tubular spacer stop 46 slides over section 44 against end 48 of section 42. A plurality of various lengthed stops 46 are provided to accommodate varying width replaceable trimmer line spools from various manufacturers. Spool 35 from a trimmer with central bore 50 slides over section 44 of member 38 after which crank handle device 52 engages the spool to hold and turn the spool. Integral device 52 includes cylindrical base 54 with lengthwise central bore 56, which allows the base to slide over and freely rotate on section 44 of member 38. "L" shaped crank handle 58 is rigidly attached to base 54 with section 60 of handle 58 extending radially outwardly from base 54. Free section 62 of handle 58 extends parallel to section 44 of member 38 and horizontally outwardly away from side member 16 to allow easy turning of base 54. Base 54 engages and interlocks with a variety of styles of spool 54 through a series of circumferential spaced projections 64 around the inside end of cylindrical base 54. Projections 64 may be narrower than are shown in this embodiment. Projections 64 engage into arc openings 66 of spool 35 and turning torque is exerted by leading edges 68 of projections 64 against sides 70 of openings 66 formed by radial cross-members 72 in spool 35. Capped pin 74 interfits through transverse hole 76 through section 44 of member 38 close to the end of section 44. Pin 74 holds cylindrical base 54 in engagement with spool 35 and cotter pin through a hole in pin 74 keeps the pin in place. With winding device 36 engaged into spool 35, turning crank handle 56 rotates spool 35 drawing line 34 from bulk roll 30 and winds the line onto replaceable trimmer spool 35. It is an easy matter to maintain tension on the line until the spool is full and secured. An alternative embodiment is shown in FIGS. 6A and 6B wherein prime (') designations indicate a similar element shown in FIGS. 5A and 5B and other figures. Replaceable trimmer spool 74 is supplied with notches 76. Cylindrical base 54' is equipped with flanges 78 which interfit into notches 76 allowing the crank and spool to interlock and turn as an integral unit.

While this invention has been described with reference to specific embodiments disclosed herein, it is not confined to the details set forth and the patent is intended to include modifications and changes that may come within and extend from the following claims.

I claim:

1. A spool winder apparatus comprising:

(A) a frame comprising a first end of the frame, a second end of the frame and a central section of the frame, (B) a first vertical rod member comprising a first end of the first vertical rod member rigidly attached to the frame proximate the first end of the frame and a second free end of the first vertical rod member extending upwardly, (C) at least one cup shaped member comprising a horizontal top, the member slideably engaged over the first rod member, (D) a second vertical rod member comprising a first end of the second vertical rod member rigidly attached to a center of the horizontal top of the cup shaped member and a second free end of the second vertical rod member extending upwardly, the combination of the first rod member, the cup shaped member, and the second vertical rod member adapted:

(i) to extend into a central opening of a filament supply spool, and (ii) to support the supply spool and allow the supply spool to rotate as the filament is drawn off the supply spool, (E) a horizontally disposed cantilever member comprising a proximal end rigidly attached to the frame proximate the second end of the frame and a free round cross-sectioned distal end section adapted:

(i) to extend into a central opening of a weed trimmer filament spool, and (ii) to support the trimmer spool and allow the trimmer spool to rotate on the free distal end section of the cantilever member, (F) a stop means on the free distal end section of the cantilever member to adjustably fix a chosen distance that the trimmer spool slides along the free end section, and (G) a crank handle device comprising:

(i) a cylindrical member interfitting over and freely rotatable on the free end section, the member having a length and first and second ends, (ii) projections from the cylindrical member adapted to interlock into openings in the trimmer spool, and (iii) an "L" shaped crank member comprising a first end section rigidly attached to the cylindrical member and extending radially outwardly from the cylindrical member and a second free end section extending parallel to the length of the cylindrical member and away from the second end of the cylindrical member.

2. The apparatus of claim 1 wherein the projections from the cylindrical member adapted to interlock into openings in the trimmer spool extend outwardly from the first end of the cylindrical member.

3. The apparatus of claim 1 wherein the second free end section of the "L" shaped crank member has a rounded cross-section.

4. The apparatus of claim 2 wherein the projections from the first end of the cylindrical member adapted to interlock into openings in the trimmer spool are arranged in a circular pattern.

5. The apparatus of claim 1 wherein the projections from the cylindrical member adapted to interlock into openings in the trimmer spool extend outwardly from the length of the cylindrical member.

6. The apparatus of claim 1 further comprising removable stop means on the free round cross-sectioned distal end section of the cantilever member to retain the crank member in position on the free distal end section of the cantilever member.

7. The apparatus of claim 1 further comprising an inverted "U" shaped member rigidly attached across the central section of the frame.

8. A spool winder apparatus comprising:

(A) a frame, (B) a first vertically positioned rod member comprising a circular cross-section, a first end of said rod member rigidly attached to the frame and a second free end of said rod member, the rod member being adapted:

(i) to extend into a central opening of a filament supply spool, and (ii) to support the supply spool and allow the supply spool to rotate as the filament is drawn off the supply spool, (C) a cantilever member having a proximal end rigidly attached to the frame and a free round cross-sectioned distal end section horizontally positioned, the member being adapted:

(i) to extend into a central opening of a weed trimmer filament spool, and (ii) to support the trimmer spool and allow the trimmer spool to rotate on the free end section, (D) a stop member on the free end section with adjustment means to fix the stop member at various positions on the free end section, (E) a crank handle device comprising:

(i) a cylindrical member interfitting over and freely rotatable on the free end section, the cylindrical member having a length and first and second ends, (ii) projections arranged in a circular pattern from the first end of the cylindrical member adapted to interlock into openings in the trimmer spool, and (iii) an "L" shaped crank member comprising a first end section firmly attached to the cylindrical member and extending radially outwardly from the cylindrical member and a second rounded cross-sectioned free end section extending parallel to the length of the cylindrical member and away from the second end of the cylindrical member, and (F) removable stop means on the second free end section of the second cantilever member to retain the crank member in position.

9. The apparatus of claim 8 wherein the cantilever rod member is horizontally disposed.

10. A spool winder apparatus comprising:

(A) a frame, (B) a bulk spool holding means on an end of the frame to support a supply spool of line and allow the supply spool to rotate as the line is drawn off the supply spool, (C) a cantilever member having a first end rigidly attached to the frame and a free round cross-sectioned end section horizontally positioned, the free end section being adapted:

(i) to extend into a central opening of a weed trimmer filament spool, and (ii) to support the trimmer spool and allow the trimmer spool to rotate on the free end section, (D) stop means on the free end section adapted to adjustably fix the trimmer spool at chosen positions along the length of the free end section, (E) a crank handle device comprising:

(i) a cylindrical member interfitting over and freely rotatable on the free end section of the cantilever member, the member having a length and first and second ends, (ii) projections from the first end of the cylindrical member adapted to interlock into openings in the trimmer spool, and (iii) an "L" shaped crank member comprising a first end section rigidly attached to the cylindrical member and extending radially outwardly from the cylindrical member and a second free end section extending parallel to the length of the cylindrical member and away from the second end of the cylindrical member, and (F) lock means on the second free end section of the cantilever member to detachably retain the crank member engaged with the trimmer spool.

11. The apparatus of claim 10 wherein the bulk spool holding means comprises a vertically positioned cantilever rod member with a circular cross-section.

12. The apparatus of claim 10 wherein the free end section of the "L" shaped crank member has a rounded cross-section.

13. The apparatus of claim 10 wherein the projections from the first end of the cylindrical member adapted to interlock into openings in the trimmer spool are arranged in a circular pattern.

14. A spool winder apparatus comprising:

(A) a frame comprising a first end of the frame, a second end of the frame and a central section of the frame, (B) a first vertical rod member having a circular cross-section, the first vertical rod member comprising a first end of the first vertical rod member rigidly attached to the frame proximate the first end of the frame and a second free end of the first vertical rod member extending upwardly, (C) at least one cup shaped member comprising a horizontal top, the member slideably engaged over the first rod member, (D) a second vertical rod member comprising a first end of the second vertical rod member rigidly attached to a center of the horizontal top of the cup shaped member and a second free end of the second vertical rod member extending upwardly, the combination of the first rod member, the cup shaped member, and the second vertical rod member adapted:

(i) to extend into a central opening of a filament supply spool, and (ii) to support the supply spool and allow the supply spool to rotate as the filament is drawn off the supply spool, (E) a cantilever member comprising a proximal end rigidly attached to the frame proximate the second end of the frame and a free round cross-sectioned distal end section adapted:

(i) to extend into a central opening of a weed trimmer filament spool, and (ii) to support the trimmer spool and allow the trimmer spool to rotate on the free distal end section of the cantilever member, (F) a stop means on the free distal end section of the cantilever member to adjustably fix a chosen distance that the trimmer spool slides along the free end section, and (G) a crank handle device comprising:

(i) a cylindrical member interfitting over and freely rotatable on the free end section, the member having a length and first and second ends, (ii) projections from the cylindrical member adapted to interlock into openings in the trimmer spool, and (iii) an "L" shaped crank member comprising a first end section rigidly attached to the cylindrical member and extending radially outwardly from the cylindrical member and a second free end section extending parallel to the length of the cylindrical member and away from the second end of the cylindrical member.

15. A spool winder apparatus comprising:

(A) a frame comprising a first end of the frame, a second end of the frame, a central section of the frame, and an inverted "U" shaped member rigidly attached across the central section of the frame, (B) a first vertical rod member comprising a first end of the first vertical rod member rigidly attached to the frame proximate the first end of the frame and a second free end of the first vertical rod member extending upwardly, (C) at least one cup shaped member comprising a horizontal top, the member slideably engaged over the first rod member, (D) a second vertical rod member comprising a first end of the second vertical rod member rigidly attached to a center of the horizontal top of the cup shaped member and a second free end of the second vertical rod member extending upwardly, the combination of the first rod member, the cup shaped member, and the second vertical rod member adapted:

(i) to extend into a central opening of a filament supply spool, and (ii) to support the supply spool and allow the supply spool to rotate as the filament is drawn off the supply spool, (E) a cantilever member comprising a proximal end rigidly attached to the frame proximate the second end of the frame and a free round cross-sectioned distal end section adapted:

(i) to extend into a central opening of a weed trimmer filament spool, and (ii) to support the trimmer spool and allow the trimmer spool to rotate on the free distal end section of the cantilever member, (F) a stop means on the free distal end section of the cantilever member to adjustably fix a chosen distance that the trimmer spool slides along the free end section, and (G) a crank handle device comprising:

(i) a cylindrical member interfitting over and freely rotatable on the free end section, the member having a length and first and second ends, (ii) projections from the cylindrical member adapted to interlock into openings in the trimmer spool, and (iii) an "L" shaped crank member comprising a first end section rigidly attached to the cylindrical member and extending radially outwardly from the cylindrical member and a second free end section extending parallel to the length of the cylindrical member and away from the second end of the cylindrical member.

* * * * *